United States Patent [19]

Tagawa

[11] Patent Number: 4,767,076

[45] Date of Patent: Aug. 30, 1988

[54] MECHANISM FOR AUTOMATICALLY FEEDING COLLECTING ELONGATED CORE OF FABRICS

[76] Inventor: Keiko Tagawa, 14-1 Hon-machi 6-chome, Toyonaka-shi, Osaka-fu, Japan

[21] Appl. No.: 933,329

[22] Filed: Nov. 19, 1986

Related U.S. Application Data

[63] Continuation of Ser. No. 566,388, Dec. 28, 1983, abandoned.

[30] Foreign Application Priority Data

Dec. 19, 1982 [JP] Japan ..... 57-196668

[51] Int. Cl.[4] ..... B65H 19/12; B65H 16/06; B65H 16/10; B65G 17/42

[52] U.S. Cl. ..... 242/58.6; 198/681; 198/803.13; 242/65; 414/911

[58] Field of Search ..... 242/58, 58.1, 58.2, 242/58.3, 58.4, 58.5, 58.6, 55.3, 80, 56 R, 56 A, 68, 68.4, 68.7, 65, 66; 414/911, 276, 278; 198/681, 803.2, 803.13, 803.14

[56] References Cited

U.S. PATENT DOCUMENTS

| | | | |
|---|---|---|---|
| 3,176,928 | 4/1965 | Saunders | 242/58.6 |
| 3,338,376 | 8/1967 | Cross | 198/803.13 |
| 3,430,881 | 3/1969 | Ebneter | 242/56 A |
| 3,520,424 | 7/1970 | Lemelson | 414/276 X |
| 3,601,270 | 8/1971 | Martin, Sr. . | |
| 4,298,173 | 11/1981 | Johansson | 242/58 |
| 4,306,646 | 12/1981 | Magni | 198/655 |
| 4,443,291 | 4/1984 | Reed | 242/58.2 X |

FOREIGN PATENT DOCUMENTS

| | | | |
|---|---|---|---|
| 2026813 | 5/1981 | Denmark . | |
| 4748822 | 5/1969 | Japan | 242/56 A |
| 64795 | 11/1976 | Japan . | |
| 113334 | 1/1979 | Japan . | |
| 1293265 | 5/1970 | United Kingdom . | |
| 1293267 | 5/1970 | United Kingdom . | |

*Primary Examiner*—Harvey C. Hornsby
*Assistant Examiner*—Scott J. Haugland
*Attorney, Agent, or Firm*—Wenderoth, Lind & Ponack

[57] ABSTRACT

A mechanism for automatically feeding and collecting elongated cores of rolled fabric, which is used with an unrolling machine for unrolling fabric from the cores. The mechanism includes elongated frames on which endless link chains circulate with pairs of hooks for supporting ends of the cores. Parallel stock arms provide cores of rolled fabric to the hooks at a rear side of the frames. The cores of rolled fabric are removed from the hooks at a forwardly extending upper portion of the frames. Guide rods below the upper portion of the frame guide empty cores from the unrolling machine to the hooks as they circulate along the lower side of the frames. Spaced collector arms direct the empty cores dropped from the hooks at the bottom of the frames, away from the frames for removal from the mechanism.

23 Claims, 4 Drawing Sheets

MECHANISM FOR AUTOMATICALLY FEEDING COLLECTING ELONGATED CORE OF FABRICS

This application is a continuation of application Ser. No. 566,388 filed Dec. 28, 1983 now abandoned.

The present invention relates to a mechanism for automatically feeding and collecting elongated cores for fabrics. More particularly, the invention relates to a mechanism for automatically feeding and collecting elongated cores for rolled fabrics which is attached to a machine for unrolling fabrics, characterized in that, an elongated core for rolled fabrics which is empty or retain a bit of fabric thereon after the completion of unrolling the fabrics can automatically be removed from the holding arm of the machine for unrolling fabrics which reciprocally runs on the stand for said machine, while an elongated core fully wound with fabric can automatically be supplied onto the holding arm of said machine.

BACKGROUND OF THE INVENTION

The conventional machine for unrolling fabrics is provided with a mechanism for automatically feeding elongated cores of rolled fabric, but does not have a mechanism for automatically collecting the elongated cores after the completion of unrolling the fabric therefrom. An explanation will be made of the conventional techique, with reference to FIG. 1 showing a simplified side view of the conventional machine for unrolling fabrics, provided with the device for feeding the rolled cores.

The conventional machine 2' for unrolling fabrics is forwardly and rearwardly movable on the stand 1'. Behind the machine for unrolling fabrics which is provided with a roll 8' for unrolling fabrics at the front end, is positioned a device 4' for automatically feeding cores of rolled fabric onto the machine 2' correspondingly. On the device 4' for automatically feeding rolled fabric, a pair of (right and left) endless link chains 9' circulates up and down, and thereon are projectedly provided, at a fixed distance, pairs of (up and down right and left) holding hooks **10*a*, 10*b*. At the front end of a stock member 4'' for rolled fabric which comprises an arm rod projecting outward from each endless link chain, a each projected end portion of the elongated core of rolled fabric is held with a bent portion of the lower one of the holding hooks. Under this condition, the roll of fabric on the stock member 4'' runs upward, forward and downward in order, and then said projected portion of the elongated core of rolled fabric is transferred onto a projected lower arm of a holding arm 5' (one for each end of the elongated core) which is waiting while inclining upward, when the roll of fabric reaches the middle of the front surface of the device 4'. Then the transferred roll of fabric is supported in the holding arm by moving over, due to its weight, the opening and closing mechanism of the hollow portion 6' for holding elongated cores of rolled fabric which is formed between said projected lower arm and an upper arm of holding arm 5'. Thus, when the holding arm has been rotated forward, the rolled fabric is unrolled by the rotation of the roll 8'** and the movement of the machine for unrolling the rolled fabrics.

According to the operation of the conventional mechanism for automatically feeding the rolled fabrics, as mentioned above, when the process of unrolling fabrics is effected by the to and fro movement of the machine and the rotation of the roll 8' is completed to leave the elongated core 3' empty or retaining remnant fabric only, each holding arm 5' which holds a projected end of the elongated core of rolled fabric is, by hand, turned over from the position of the front end shown single-dotted chain line to the position of the rear end shown is solid line in FIG. 1. Then both projected portions of said elongated core, which are held fast by the hollow portions 6', are forced out of the opening and closing stopper mechanism 7 to move downward. After the empty core is received by hand, the empty holding arm 5' is rotated from the position shown in solid line to the position shown by double-dotted chain line in FIG. 1. Thereafter the holding arm receives the elongated core 3' with rolled fabric 3 thereon which is newly supplied by the holding hooks **10*a*, 10*b* provided on the endless link chains circulating in the direction shown by an arrow on the device 4'** for automatically feeding elongated cores of rolled fabric. According to the operation as described above, although the elongated core of rolled fabric can be automatically set on the machine for unrolling fabric, the removal of the empty core from the machine for unrolling fabric, after completion of the unrolling, is required to be done by hand. That is, the whole process of setting and removing the elongated core for rolled fabric cannot be effected automatically.

SUMMARY OF THE INVENTION

The primary object of the present invention is to provide a mechanism for automatically feeding and collecting elongated cores for rolled fabric which is used with a machine for unrolling fabric, characterized in that each operation of removing elongated cores after the completion of unrolling of fabrics therefrom, and of setting a newly supplied core of rolled fabric on the machine for unrolling fabric can be effected automatically by the provision of a pair of holding hooks, guide rods for collecting empty cores, and a member for collecting empty cores.

DETAILED DESCRIPTION OF THE INVENTION

The preferred embodiment of the present invention is explained in detail with reference to the accompanying drawing.

Figure 1:
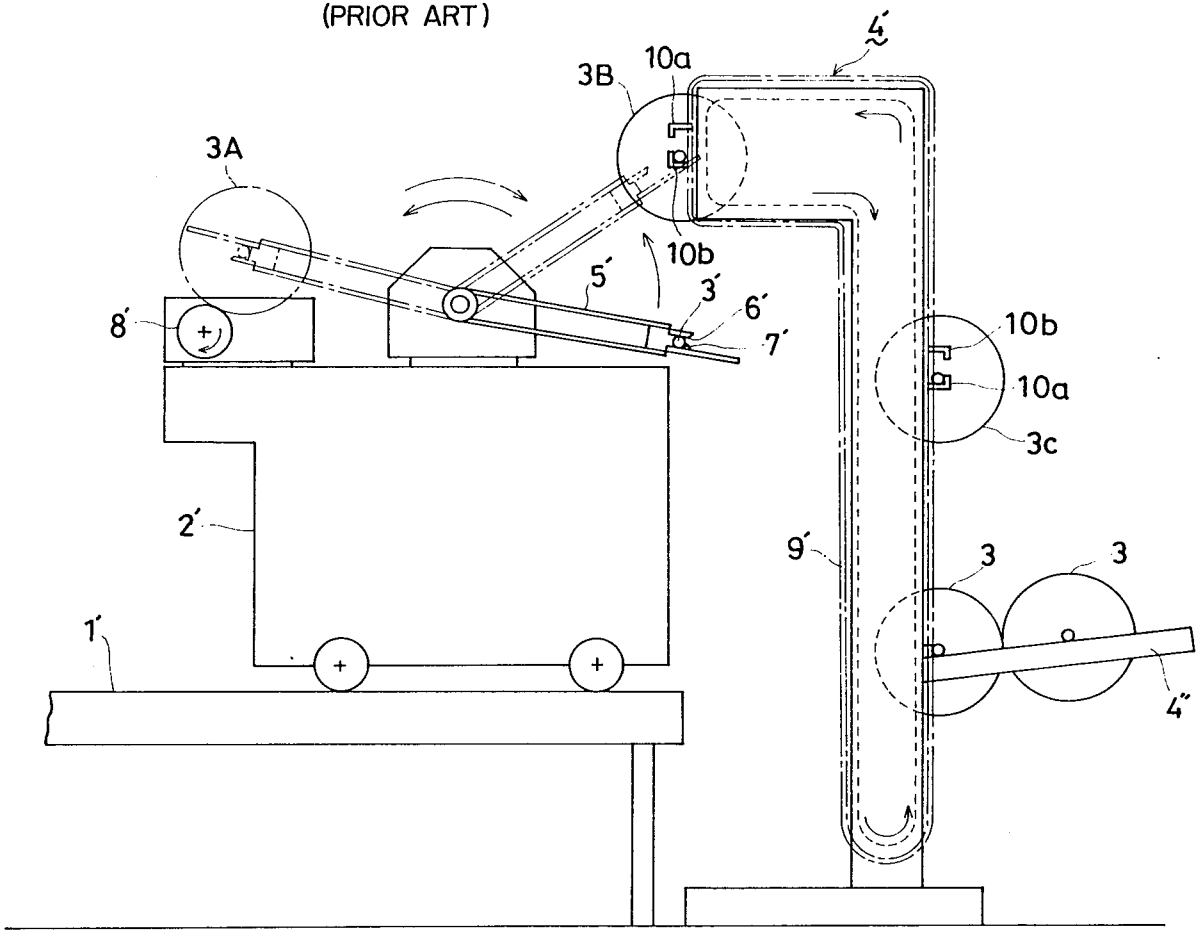
FIG. 1 (PRIOR ART)
FIG. 1 is a side view showing an embodiment of the conventional device for automatically feeding elongated cores of rolled fabrics, attached to a machine for unrolling fabrics.
Figure 2:
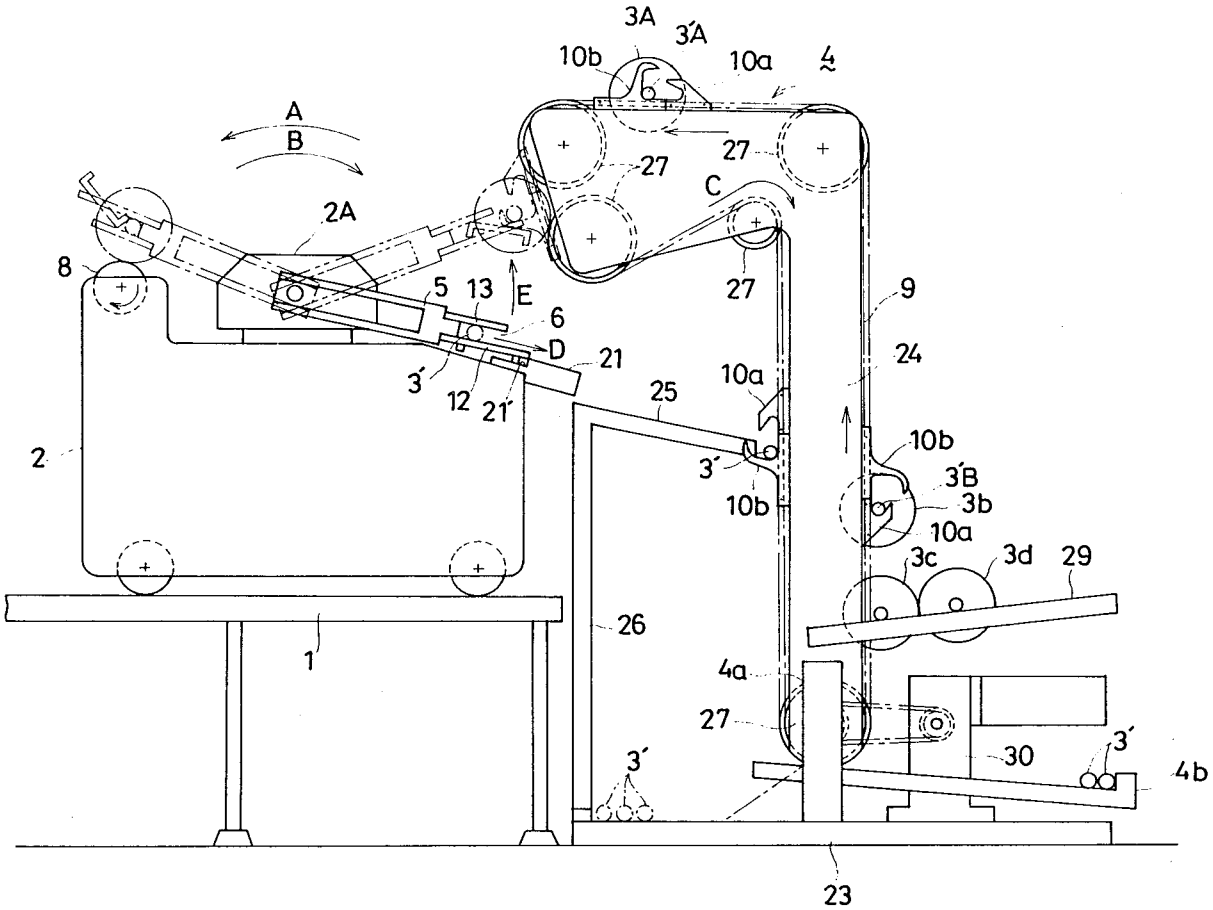
FIG. 2 is a side view showing an embodiment of the mechanism for automatically feeding and collecting elongated cores of rolled fabrics, attached to the machine for unrolling fabrics, according to the present invention.
Figure 4:
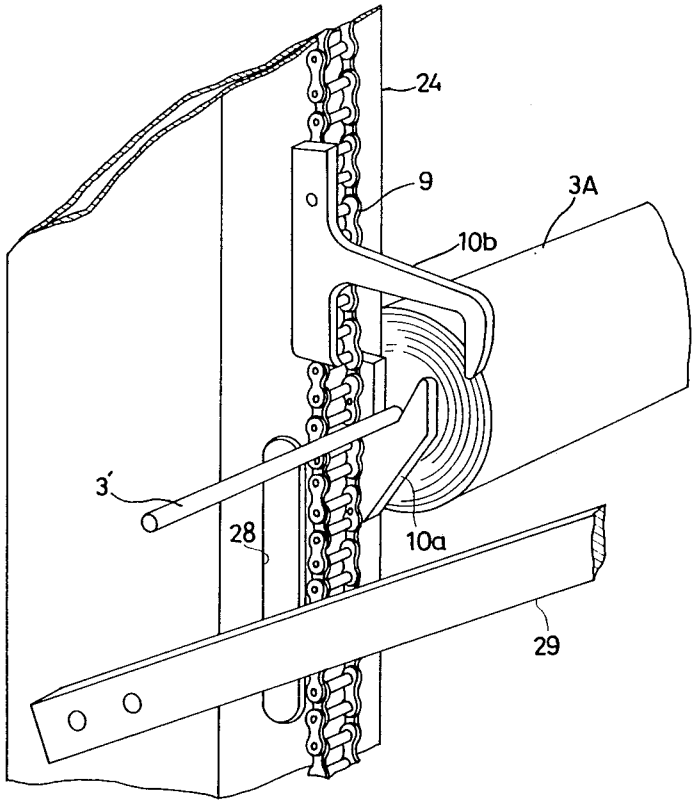
FIG. 4 is an enlarged perspective view of the essential part of the holding hooks in the mechanism of FIG. 2.

In FIGS. 2 and 4, the mechanism 4 for automatically feeding and collecting elongated cores of rolled fabrics 3a, 3b, 3c, 3d . . . , which is attached to the machine 1 for unrolling fabrics, is placed at the back of the machine 1, and comprises a two (right and left) longitudinal frames 24 on each of which an endless link chain circulates up and down, a stock member 29 for rolled fabrics which is provided projectingly on the lower end of each longitudinal frame 26, to the opposite side of a holding frame which is projectingly provided at the lower front of the longitudinal frame and used for collecting empty elongated cores, guide rods 25 which are provided inclinedly from the upper end of the holding frame 26 toward the front surfaces of the respective longitudinal frames 24, a member 4b for collecting empty cores which is provided inclinedly on the lower inside of a fixing frame 4a which extends longitudinally, outward of the lower end of both longitudinal frames 24 from the base 23, the guide rods and the member for collecting empty cores being the characteristic features of the present invention. On the right end left endless link chains, several pairs of (upper and lower) holding hooks 10a, 10b for holding elongated core of rolled fabrics are projectingly provided at fixed intervals. On the base 23 on which the above mentioned main structures are provided, is placed a motor 30.

The right and left longitudinal frames 24 have shape when viewed from the side as in FIG. 2 of a reversed inverted L, and the upper, bending arm thereof is projected above the the machine for unrolling fabrics. On the frames 24 are provided five sprockets 27, on the respective outside corners of the upper bending arm and the outside surface of the lower end. On each sprocket the endless link chain 9 is supported and circulates in the upward, forward, downward and backward directions as shown by an arrow C in FIG. 2, by conveyance of driving power from the motor 30 to the sprocket 27 at the lower end by a pulley.

Figure 5:
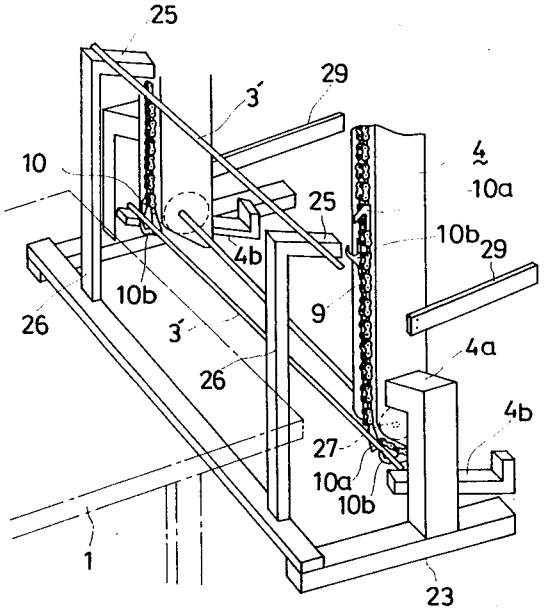
FIG. 5 is an enlarged perspective view of the essential part of the member for collecting elongated cores of fabrics in the mechanism of FIG. 2.

As is illustrated in FIG. 5, the holding frame 26 for collecting empty cores has a shape of the square, one side of which is open. The front upper end of the guide rods 25 which constitutes the upper portion of the holding frame 26 project slightly downward, rearward from the rear end of the machine for unrolling fabrics. When the arms 5 for supporting the elongated core for rolled fabric are rotated backward, the core is led onto the guide rod 25 passing on the guide plate 21 (see FIGS. 2 and 5). In such a construction, when the elongated empty core 3' descends from the rear and upper position on the endless link chain and rolls down the incline at the base of the holding frame (shown in phantom line in FIG. 2), it can be prevented from rolling out due to the front, longitudinal rods of said holding frame 26. In another embodiment, the guide rods 25 may be provided so as to project from both sides of frame 24 to the back side of the machine for unrolling fabrics. Alternatively, the guide rods may be provided inclinedly on the upper end of a holding frame which is separately provided, and when necessary, they may be used by moving said rods to the front of the longitudinal frame. In this case, the empty core of fabrics may be liberated directly on the base or may be collected in a box or frame separately prepared.

The present inventor had previously proposed the mechanism for automatically feeding and collecting elongated core of rolled fabrics (cf. Japanese Utility Model Application No. 161935/1982, filed on Oct. 25, 1982), which comprises much of the construction as described above. In that proposed mechanism, since the holding frame for collecting empty cores is provided between the longitudinal frame and the machine for unrolling fabrics, the removal of the empty cores which have been removed from the machine for unrolling fabrics could not be smoothly effected in the narrow space provided. To overcome that disadvantage, in the present invention, the member 4b for collecting empty cores is provided, whereby the collection of empty cores can be easily effected by liberating empty cores in the space to the back of the longitudinal frames where no obstacles exist.

In FIG. 5, the fixing frames 4a are provided in positions outward of the lower sprockets 27, on the base 23 in such a manner that and fixing frame is integrated with the base, or it can be freely attached to or removed from the base. The members 4b for collecting empty cores are also positioned outward of the sprockets 27, are inclined downward to the back of the fixing frames 4a to roll empty cores 3' rearward thereonto the rear end thereof and are shaped to support the most respective outer ends of the empty cores 3'.

In FIG. 2, there are illustrated three pairs of the holding hooks 10a,10b, each pair of right and left hooks circulating synchronously, while holding each projecting end portion of respective elongated core of rolled fabric 3'A, 3'B . . . . Referring to FIG. 4 showing an enlarged perspective view of the essential part of one longitudinal frame, a pair of upper and lower hooks is fixed rotatably with a pin or the endless link chain 9 circulating up and down along the back end surface of the longitudinal frame 24, in such a manner that said upper and lower hooks are fixed in a different height on the outer surface of the upper link and the inner surface of the lower link, respectively. On the upward, forked portion of the right and left holding hooks 10a, are horizontally held the right and left projecting portions of the elongated core of rolled fabric 3'A, whereby the elongated core of rolled fabric circulates on the endless link chain in the upward, cross, oblique and downward directions without being out of the holding hooks. During this circulation, the projecting portions of the elongated core are fitted into the forked portion of either of the holding hooks 10a and 10b. The numeral 28 designates a clearance groove.

On the stock number 29 for rolls of fabric, there are laid rolls of fabric 3b,3c . . . as a reserve supply, which are prepared to slide forward on the stock member in order. The right and left projecting arms of said stock member are provided on the most outer side of the rear end of the respective longitudinal frames. On the inner side of each longitudinal frame is provided the clearance groove 28. The holding hook 10b is fixed with a pin on the outside end surface of the link chain so as to fit in the clearance groove.

Figure 3:
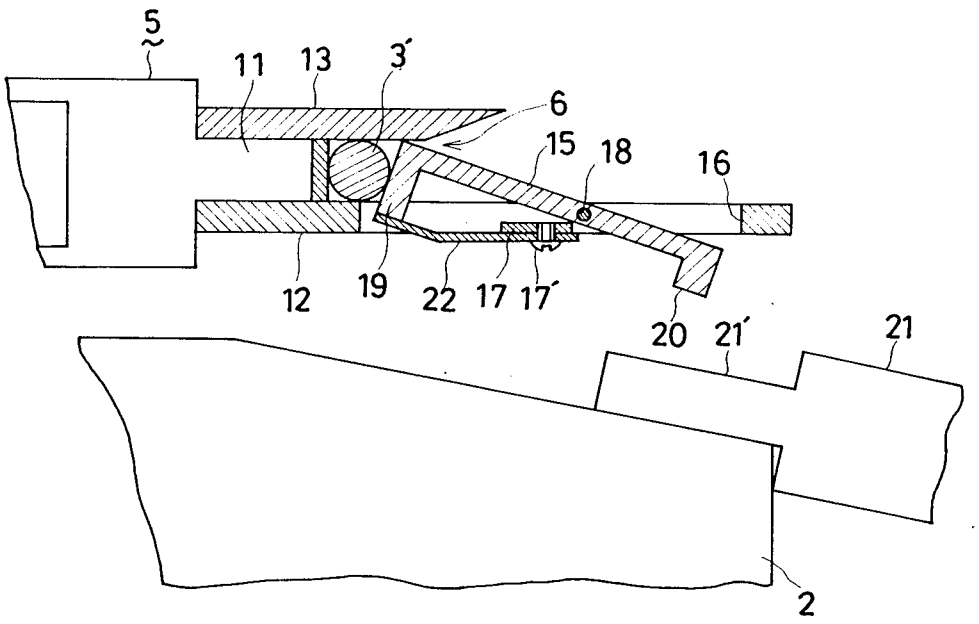
FIG. 3 is an enlarged vertical sectional view of the essential part of the holding arm in the mechanism of FIG. 2.

Facing the mechanism 4 for automatically feeding and collecting elongated cores of rolled fabrics as constructed above, there is installed the machine 2 for unrolling fabrics, on the upper surface of which an installation-base portion 2A is provided. On both sides thereof holding arms 5 are fixed in such a manner as being capable of rotating forward and backward in the angle of about 180° as shown by arrows A and B in FIG. 2. Referring to FIG. 3, the projecting end portion of a holding arm constitutes a hollow member 6 for supporting a projecting end of an elongated core of fabric, which comprises a lower arm 12 and an upper arm 13. On the lower arm 12, is fixed a stopper 15 which opens and closes an opening of the hollow member 6 so as to support an elongated core of rolled fabrics in the hollow member 6. In such a construction as above, when usual, each end of the elongated core of rolled fabric 3' is supported in a hollow member 6 in such a manner that the stopper is forcibly directed forward and upward by a free end of a sheet spring 22. When the holding arms 5 rotates backward, each stopper is kept horizontally by a stopping board 17 against the strength of the sheet spring by the action of the back, lower end surface 20 of the stopper 15 striking against a projecting inclined board 21' of an inclined guide board 21 which is provided on the rear end of the machine 2, whereby the elongated core of fabric 3' can be moved rolling on guide boards 21 from the hollow members 6. In FIGS. 2 and 3, reference numeral designates a stand on which the machine for unrolling fabrics is set, reference numeral 8 designates a roll for unrolling fabrics, reference numeral 13 an upper arm, reference numeral 16 designates a perforated hole, reference numeral 17' designates a set screw and reference numeral 19 designates a bent front arm of the stopper 15.

The above-constructed machine for unrolling fabrics and mechanism for automatically feeding and collecting elongated cores of fabrics, when necessary, are provided with an automatic controlling member (not shown in Figures) in which necessary data such as length of unrolling fabrics, the number of cores of rolled fabrics, etc. are stored, whereby the whole processes, such as collection of cores of fabrics 3' (e.g. empty cores), setting of newly supplied cores of rolled fabrics 3' onto the holding arm 5, unrolling of rolled fabrics, running of the machine for unrolling fabrics, etc. are automatically effected.

The operation of the above-constructed mechanism for automatically feeding and collecting cores of rolled fabrics which is attached to the machine for unrolling fabrics is as follows.

When the operation of unrolling rolled fabrics is initiated by running of the machine 2 for unrolling fabrics with a motor driven by an automatic controlling device, rotation of the roller for unrolling fabrics and rotation of the endless link chains 9, the holding arms 5, as shown in FIG. 2, receive the elongated core 3' of the rolled fabric 3A descending from the upper portion of the longitudinal frames, at the waiting position shown by a double-dotted chain line. The core 3' of rolled fabric 3A is fitted into the hollow member 6 due to its weight, and thereafter each holding arm with the rolled fabric is rotated forward whereby the unrolling operation is initiated. The holding hooks **10*a*,10*b* which are free from the rolled fabric descend closing to the upper end of the holding frame. Concurrently, the next holding hooks 10*a*,10*b* on the endless link chains receive the next core of rolled fabric from the rolled fabrics-stock member 29 so as to carry the same upward, and await their turn on the upper portion of the longitudinal frames 24 while holding the said next core. As this time, the third holding hooks 10*a*,10*b* receive the newly supplied core 3' from the stock member 29** and begin to ascend on the endless link chains.

As the unrolling operation proceeds, the holding arms which hold the empty core after the completion of unrolling fabric, are rotated backward to the rear end of the machine 2, as shown in FIG. 2. At this time, as shown in FIG. 3, the rear, lower end 20 of the stopper 15 is contacted and urged by the projecting board 21' of the guide board 21 so as to rotate downward the bent arm 19 on the axis 18 in resistance to the strength gained by spring 22. Thus, the stopper 15 becomes on the same level with the projecting lower arm 12, and then, the empty core 3' which has been supported in the hollow members 6, immediately descends rolling on the projected lower arm 12 in the direction as shown by an arrow D in FIG. 2, moves backward on the upper surface of the guide rods 25 which are projected from the upper end of the holding frame or member 26 for collecting empty cores toward the longitudinal frames, and then falls into the upward portion of the holding hooks **10*b* to be supported thereon. The holding hooks 10*b* holding the empty core descend on the endless link chains in such a manner that the holding hooks 10*b* are projected forward from the holding portion of the holding hooks 10*a* by slightly inclining forward with lower pins as fulcrums. When the holding hooks 10*b* reach the respective turns of the endless link chains to the bottom of the holding frame, the empty core rolls out from the holding portion of the holding hooks 10*b* on the members 4*b* for collecting empty cores, which project between the inner surface of the fixing frame 4*a* longitudinally provided outside of the longitudinal frame. In another embodiment wherein the holding frame is provided at the front side on base 23, as shown by a dotted chain line in FIG. 2, the inclined surface of the members 4*b* are effectively replaced by a surface of reverse slope and the core of fabric is collected in the holding frame so as to be taken out. The empty holding hooks 10*a*,10*b* go along the curved portion of the frame and proceed upward. When they reach the stock member, they receive the rolled fabrics. The empty core 3' which has rolled down on the members 4*b* for collecting the same is supported with a stopper member at the lower end of the members 4*b*** or in case of providing no stopper member, the empty core is supported by a collecting device appropriately provided.

On the other hand, the holding arms 5 the hollow members 6 of which become empty by the rotation of the core therefrom, is rotated upward as shown by an arrow E (as shown by a double-dotted chain line in FIG. 2). Synchronously with this movement, the holding hooks **10*a*, 10*b* which hold the core 3' for the rolled fabrics 3A while waiting on the upper portion of the longitudinal frame descends to the position as shown by said double-dotted chain line in FIG. 2, where the core of rolled fabrics is to be received by the holding arms. Then, after the holding arms 5 receive the core 3' of the rolled fabrics, the holding arm are rotated in the direction of the unrolling roll 8**, whereby the unrolling operation is reinitiated.

Further, explaining in more detail the operation of the holding hooks **10*a*, 10*b* which have ascended to the said stock member, on each endless link chain ascending, both projecting portions of the core of fabric which is laid on the stock member is first touched by the holding hook 10*b* coming upward which faces downward and has no holding portion. Therefore, said holding hook 10*b*, which projects to get in the way of the projected portion of the core, sways using the upper pin as a fulcrum and enters into the clearance groove. Then the holding hook 10*a***, which is positioned slightly downward, ascends to hold the projected portion of the core of fabric.

According to the present invention, the mechanism for automatically feeding and collecting the core of rolled fabric used for the machine for unrolling fabrics has the following advantages.

(1) Between the longitudinal frames 24 and the machine for unrolling fabrics there is provided the holding frame for collecting empty cores which has a simple structure and corresponds in operation to the holding hooks on the endless link chains, whereby the empty core can be transferred from the holding arms to the holding hooks 10*a*,10*b* without manual intervention, and can be taken out easily and safely. Further, since the empty core can be carried to the bottom of the holding frame by the holding hooks, there is no fear of creating noises and breaking cores of fabrics by dropping the same from a high place.

(2) The empty core of fabric which is taken out only by circulation of the endless link chains can be automatically collected by the holding frame for collecting the same.

(3) Each operation of taking out empty cores after the completion of unrolling fabric and of subsequently setting the next core of rolled fabric can be completely automatically effected without manual intervention.

(4) The simply constructed guide rods 25 for collecting empty cores and the members 4*b* for collecting empty cores are provided between the longitudinal frames 24 and the machine for unrolling fabrics and respectively project to the back of the longitudinal frame, the guide rods 25 and the members 4*b* being located with respect to the holding hooks on the endless link chains so that the empty core can be transferred from the holding arms to the holding hooks 10*a*, 10*b* without requiring manual intervention with ease and safety, and since the empty core can be carried to the bottom portion of the longitudinal frame by the holding hooks, the empty core is never dropped from a height to be broken or to create any noise.

(5) The empty core which has been taken out only by circulation of the endless link chains can automatically be transferred to and collected in the members 4*b* from which they may be later removed.

(6) Since the members 4*b* for collecting cores are provided so as to project to the most rear portion of the longitudinal frame, each operation of taking out empty cores after the completion of unrolling fabric and of subsequently setting the newly supplied core of rolled fabric can be carried out without manual intervention, and in addition, can automatically be carried out with safety on the open portion, not on the lower portion of the back end of the machine for unrolling fabrics, which is more dangerous.

What is claimed is:

1. A mechanism for automatically feeding elongated cores having projecting portions at opposite ends thereof and having fabric rolled thereabout, to an unrolling machine for unrolling the fabric from the cores, and for automatically collecting the cores after the fabric has been unrolled therefrom, said mechanism comprising:

(a) first and second spaced, side-by-side, vertically extending frames, each having a forwardly extending upper portion for extending toward the unrolling machine and a lower portion below said upper portion having a back rearwardly facing side, a front forwardly facing side opposite said back side and a bottom side below and between said front and back sides;

(b) first and second endless chains respectively mounted on said first and second frames for synchronous continuous movement about the respective peripheries thereof;

(c) a first holding hook means and a second holding hook means, respectively mounted on said first and second chains for movement therewith, for supporting the respective projecting portions of one of the cores, such that the core is removable therefrom at said upper portions of said frames, said first and second hook means respectively including first holding hooks respectively mounted on said first and second chains so as to be pivotable about an axis extending perpendicularly to the direction of movement of said first and second chains, and second holding hooks respectively mounted on said first and second chains so as to be below said first hooks when positioned along said back sides of said frames, said second hooks respectively facing the first hooks respectively mounted on said first and second chains, peripheral surfaces of said upper and lower portions of said frames being engagable with said first hooks to block pivotal movement thereof along said upper portions of said frames, along said front sides and said back sides of said frames, and said back sides of said frames each having a respective clearance groove therein, said first hooks being pivotable into respective ones of said grooves;

(d) means, disposed on said back sides of said frames adjacent said grooves, for automatically supplying the core, with the fabric rolled thereabout, onto said second hooks with the projecting portions of the core supported by said second hooks between said first and second hooks, such that the core is shifted by gravity to be supported on said first hooks at said upper portions and said front sides of said frames, said supplying means being disposed so as to direct the core toward said first and second chains such that the projecting portions of the cores engage and pivot said first hooks into said respective grooves prior to being supplied onto said second hooks;

(e) means, including first and second guide rods, for guiding the core on said first and second guide rods onto said first hooks at said front sides of said first and second frames, said first and second guide rods extending rearwardly and downwardly from respective front ends to respective rear ends thereof, respectively toward said front sides of said first and second frames, said first and second guide rods being spaced so as to slidingly support the respective projecting portions of the core when the core is disposed thereon, such that when respective portions of the core are provided onto said first and second guide rods by the unrolling machine after the fabric has been unrolled from the core by the unrolling machine, said first and second guide rods slidingly guide the core to said rear ends of said guide rods for being received on said first hooks at said front sides of said frames; and (f) means for automatically removing the core on said first and second hooks from said first and second hooks at said bottom sides of said frames.

2. A mechanism as in claim 1, wherein said first and second hook means comprise a plurality of first and second hooks equally spaced about said first and second endless chains.

3. A mechanism as in claim 1, wherein said automatically removing means comprises a collecting member having first and second spaced collector arms inclined downwardly and rearwardly from below said bottom sides of said frames to a location rearward of said back sides of said frames so that the cores removed from said first and second hooks at said bottom sides of said frames roll downwardly and rearwardly on said collecting member.

4. A mechanism as in claim 3, further comprising:

means for driving said first and second chains; and a support stand having a front portion forward of said front sides of said frames, a back portion rearward of said back sides of said frames, and a central portion between said front and back portions of said support stand; said first and second frames being mounted on said central portion; said automatically supplying means comprising a stock member which includes first and second spaced stock arms inclined upwardly and rearwardly respectively from said back sides of said first and second frames, said arms being spaced so as to be able to support the projecting ends of a plurality of successively adjacent cores rolled with fabric such that the core closest said rear sides of said frames is automatically engaged, and removed and carried away from said stock member, by ones of said first and second hooks as said hooks move therepast with the continuous movement of said first and second chains; said first and second guide rods being located entirely forward of and between said first and second frames.

5. A mechanism as in claim 4, wherein said first and second hook means comprise a plurality of first and second hooks equally spaced about said first and second endless chains.

6. A mechanism as in claim 5, wherein said driving means is mounted on said support stand.

7. A mechanism as in claim 4, wherein said driving means is mounted on said support stand.

8. A mechanism as in claim 4, further comprising first and second holding members mounted on said front portion of said support stand, said holding members having top ends having said first and second guide rods respectively formed integrally therewith, said first and second holding members and said first and second guide rods being located directly below said forward extending upper portions of said first and second frames.

9. A mechanism as in claim 4, further comprising first and second fixing members fixed to and upstanding from said central portion of said support stand and respectively mounting said first and second frames thereto, said first and second spaced collector arms being respectively fixed to said first and second fixing members and extending to respective lower ends rearward of said back sides of said frames.

10. A mechanism as in claim 9, wherein said first and second spaced collector arms respectively comprise first and second stop members at the lower ends thereof.

11. A mechanism for automatically feeding, unrolling and collecting elongated cores having projecting portions at opposite ends thereof and having fabric rolled thereabout, said mechanism comprising:

(a) means for unrolling the fabric from the cores;

(b) first and second spaced, side-by-side, vertically extending frames, each having a forwardly extending upper portion extending toward said unrolling means and a lower portion below said upper portion having a back rearwardly facing side, a front forwardly facing side opposite said back side and a bottom side below and between said front and back sides;

(c) first and second endless chains respectively mounted on said first and second frames for synchronous continuous movement about the respective peripheries thereof;

(d) at least one pair of first and second holding hook means, respectively mounted on said first and second chains for movement therewith, for supporting the respective projecting portions of one of the cores, such that the core is removable therefrom at said upper portions of said frames, said unrolling means having means for removing the core from said first and second hook members at said upper portions of said frames;

(e) means, disposed at said back sides of said frames, for automatically supplying the core, with the fabric rolled thereabout, onto one pair of said at least one pair of first and second hook means with the projecting portions of the core supported by said first and second hook means of said one pair;

(f) means, including first and second guide rods, for guiding the core on said first and second guide rods onto said at least one pair of first and second hook means at said front side of said first and second frames, said first and second guide rods extending forwardly and downwardly from respective front ends to respective rear ends thereof, respectively toward said front sides of said first and second frames, said first and second guide rods being spaced so as to slidingly support the respective projecting portions of the core when the core is disposed thereon, said unrolling means further including means for placing the core so that respective projecting portions of the core are provided onto said first and second guide rods at said front ends after the fabric has been unrolled from the core by said unrolling means, whereby said first and second guide rods slidingly guide the core to said rear ends of said guide rods for being received on said at least one pair of first and second hook means at said front side of said frames; and (g) means for automtically removing the core on said at least one pair of first and second hook means at said bottom sides of said frames;

said unrolling means comprising:

pivotable holding arms having respective free ends reciprocally pivotably movable among an unrolling position and a position adjacent the upper portions of said frames and the front sides of said frames, said holding arms each including a hollow portion opening through an opening toward said free end for receiving a respective one of the projecting portions of the core therein through said opening, a support portion between said free end and said opening, a stopper lever pivotably mounted to said support portion for pivotal movement about a horizontal axis, said lever having a first end pivotal between respective positions closing said opening and below said opening, and having a second end opposite said first end, spring means, engaging said first end for biasing said first end toward said first position to hold the projecting portion in said hollow portion, and means for receiving the respective projecting portion of the core from a respective one of said first and second hook means when said free end is in the position adjacent said upper portions of said frames and the respective hook means passes thereby, and guiding the core onto an upper surface of said lever between said horizontal axis and said first end, so as to pivot said first end against the bias of said spring means to said second position under the force of gravity, whereby the core is slidable past said first end through said opening into said hollow portion and said first portion then pivots upward under the bias of said spring means to said first position to hold the respective projecting portion in said hollow portion; and means for engaging the second ends of the levers of the respective holding arms when said holding arms move to the position adjacent the front sides of said frames so as to pivot the levers from said first position to said second position whereby the projecting portions of the core in the hollow portions are slidable through the openings over the levers onto the first and second guide rods.

12. A mechanism as in claim 11, wherein said at least one pair of first and second hook means comprises a plurality of pairs of first and second hooks equally spaced about said first and second endless chains.

13. A mechanism as in claim 11, wherein said automatically removing means comprises a collecting member having first and second spaced collector arms inclined downwardly and rearwardly from below said bottom sides of said frames to a location rearward of said back sides of said frames so that the cores removed from said at least one pair of first and second hook means at said bottom sides of said frames roll downwardly and rearwardly on said collecting member.

14. A mechanism as in claim 13, further comprising:

means for driving said first and second chains; and a support stand having a front portion forward of said front sides of said frames, a back portion rearward of said back sides of said frames, and a central portion between said front and back portions of said support stand; said first and second frames being mounted on said central portion; said automatically supplying means comprising a stock member which includes first and second spaced stock arms inclined upwardly and rearwardly respectively from said back sides of said first and second frames, said arms being spaced so as to be able to support the projecting ends of a plurality of successively adjacent cores rolled with fabric such that the core closest to said rear sides of said frames is automatically engaged, and removed and carried away from said stock member, by said one pair of said at least one pair of first and second hook means as said at least one pair moves therepast with the continuous movement of said first and second chains; said first and second guide rods being located entirely forward of and between said first and second frames.

15. A mechanism as in claim 14, wherein said at least one pair of first and second hook means comprises a plurality of pairs of first and second hooks equally spaced about said first and second endless chains.

16. A mechanism as in claim 15, wherein said driving means is mounted on said support stand.

17. A mechanism as in claim 14, wherein said driving means is mounted on said support stand.

18. A mechanism as in claim 14, further comprising first and second holding members mounted on said front portion of said support stand, said holding members having top ends having said first and second guide rods respectively formed integrally therewith, said first and second holding members and said first and second guide rods being located directly below said forward extending upper portion of said first and second frames.

19. A mechanism as in claim 14, further comprising first and second fixing members fixed to and upstanding from said central portion of said support stand and respectively mounting said first and second frames thereto, said first and second spaced collector arms being respectively fixed to said first and second fixing members and extending to respective lower ends rearward of said back portions of said frames.

20. A mechanism as in claim 19, wherein said first and second spaced collector arms respectively comprise first and second stop members at said lower ends thereof.

21. A mechanism as in claim 11, wherein said holding arms are angled upward when said first ends are in the position adjacent said upper portions of said frames, whereby the core slides by force of gravity past the first ends so that the projecting portions pass through said openings into said hollow portions when said first ends are in the position adjacent said upper portions of said frames, and wherein said holding arms are angled downward when said first ends are in the position adjacent said front sides of said frames, whereby the core slides by force of gravity so that the projecting portions pass from said hollow portions through said openings over said levers onto the first and second guide rods when the first ends of the holding arms are in said position adjacent said front sides of said frames.

22. A mechanism as in claim 21, wherein said first and second hook means respectively include first holding hooks respectively mounted on said first and second chains so as to be pivotable about an axis extending perpendicularly to the direction of movement of said first and second chains, and second hooks respectively mounted on said first and second chains so as to be below said first hooks when positioned along said back sides of said frames, and respectively facing the first hooks respectively mounted on said first and second chains, peripheral surfaces of said upper and lower portions of said frames being engagable with said first hooks to block pivotal movement thereof along said upper portions, said front sides and said back sides of said frames, said back sides of said frames each having a respective clearance groove therein, said first hooks being pivotable into said grooves; said supplying means comprising means, disposed on said back sides of said frames adjacent said grooves, for automatically supplying the core, with the fabric rolled thereabout, onto said second hooks with the projecting portions of the core supported by said second hooks between said first and second hooks, such that the core is shifted by gravity to be supported on said first hooks at said upper portions and said front sides of said frames, said supplying means being disposed so as to direct the core toward said first and second chains such that the projecting portions of the cores engage and pivot said first hooks into said grooves prior to being supplied onto said second hooks.

23. A mechanism as in claim 11, wherein said holding arms are angled upward when said first end is in the position adjacent said upper portions of said frames, whereby the core slides by force of gravity past the first ends so that the projecting portions pass through said openings into said hollow portions when said first ends are in the position adjacent said upper portions of said frames, and wherein said holding arms are angled downward when said first ends are in the position adjacent said front sides of said frames, whereby the core slides by force of gravity so that the projecting portions pass from said hollow portions through said openings over said levers onto the first and second guide rods when the first ends of the holding arms are in the position adjacent said front sides of said frames.

* * * * *